US010865588B2

(12) United States Patent
Raz

(10) Patent No.: US 10,865,588 B2
(45) Date of Patent: Dec. 15, 2020

(54) SECURING MECHANISM FOR A SLIDING PANEL

(71) Applicant: Dan Raz Ltd., Tirat Carmel (IL)

(72) Inventor: Amir Raz, Haifa (IL)

(73) Assignee: Dan Raz Ltd., Tirat Carmel (IL)

( * ) Notice: Subject to any disclaimer, the term of this patent is extended or adjusted under 35 U.S.C. 154(b) by 160 days.

(21) Appl. No.: 15/745,440

(22) PCT Filed: Jun. 23, 2016

(86) PCT No.: PCT/IL2016/050671

§ 371 (c)(1),
(2) Date: Jan. 17, 2018

(87) PCT Pub. No.: WO2017/033177

PCT Pub. Date: Mar. 2, 2017

(65) Prior Publication Data

US 2018/0209175 A1 Jul. 26, 2018

Related U.S. Application Data

(60) Provisional application No. 62/208,856, filed on Aug. 24, 2015.

(51) Int. Cl.

| | |
|---|---|
| ***E05B 63/00*** | (2006.01) |
| ***E05B 65/08*** | (2006.01) |
| ***E05C 3/12*** | (2006.01) |
| ***E05C 3/14*** | (2006.01) |
| ***E05C 19/00*** | (2006.01) |
| ***E05B 17/00*** | (2006.01) |

(52) U.S. Cl.
CPC ..... *E05B 63/0052* (2013.01); *E05B 17/0025* (2013.01); *E05B 65/0852* (2013.01); *E05C 3/124* (2013.01); *E05C 3/14* (2013.01); *E05C 19/002* (2013.01); *E05C 19/007* (2013.01)

(58) Field of Classification Search
CPC ..... E05C 19/002; E05C 19/007; E05C 3/124; E05B 63/0052; E05B 63/0852
See application file for complete search history.

(56) References Cited

U.S. PATENT DOCUMENTS

| | | | |
|---|---|---|---|
| 313,742 | A | 3/1886 | Kintner |
| 435,658 | A | 9/1890 | Brennaman |
| 888,038 | A | 10/1907 | Tong |

(Continued)

FOREIGN PATENT DOCUMENTS

| | | |
|---|---|---|
| AU | 6273346 | 2/1991 |
| AU | 641561 | 5/1992 |

(Continued)

*Primary Examiner* — Gregory J Strimbu
(74) *Attorney, Agent, or Firm* — Mark M. Friedman

(57) ABSTRACT

A sliding door includes a panel configured to slide along a path; a holding member including an abutting portion and defining a channel configured for receiving therein at least a segment of the panel; and a stop member being displaceable between an engaged state in which a first end of the stop member engages the abutting portion and a second end of the stop member engages the segment thereby precluding sliding of the panel in a direction away from the holding member and a disengaged state in which the stop member allows sliding of the panel.

12 Claims, 11 Drawing Sheets

(56) References Cited

U.S. PATENT DOCUMENTS 1,185,422 A * 5/1916 Mammelli ..... E05C 3/124 292/227
1,231,069 A 6/1917 Scaffert
1,609,342 A 12/1926 Winters et al.
1,973,461 A 9/1934 Barringer
2,029,901 A 2/1936 Voight
2,108,965 A 2/1938 Gray
2,572,717 A 10/1951 Gersten
2,579,875 A 12/1951 Stanko
2,812,204 A 11/1957 Squire
2,834,066 A 5/1958 Lybarger
2,978,757 A 4/1961 Ammerman
3,019,493 A 2/1962 Walenga
3,002,592 A 10/1963 Quinn
3,159,093 A 12/1964 Rosenfeld
3,172,168 A 3/1965 Suska
3,222,098 A 12/1965 Hausfeld
3,596,954 A 8/1971 Hull et al.
3,634,962 A 1/1972 Peterson
3,841,516 A 10/1974 Marz
3,872,696 A 3/1975 Geringer
3,877,282 A 4/1975 Pogonowski
3,924,884 A 12/1975 Christie
3,959,927 A 6/1976 Good
3,973,794 A 8/1976 Green
4,004,629 A 1/1977 Kelly
4,010,239 A 3/1977 Dor
4,045,065 A 8/1977 Johnson
4,056,276 A 11/1977 Jarvis
4,062,576 A 12/1977 Jennings et al.
4,106,239 A 8/1978 Bancroft et al.
4,110,867 A 9/1978 Gwozdz
4,126,965 A 11/1978 Hoffmann
4,133,142 A 1/1979 Dzus, Jr.
4,178,859 A 12/1979 Seiz
4,180,287 A 12/1979 Youngblood et al.
4,216,956 A 8/1980 Ichinomiya et al.
4,230,351 A 10/1980 Bisbing
4,300,795 A 11/1981 Jennings
4,367,610 A 1/1983 Goode
4,428,153 A 1/1984 Klinger et al.
4,441,277 A 4/1984 Naylor
4,534,587 A 8/1985 Fleming
4,610,472 A 9/1986 Billingsley
4,643,005 A 2/1987 Logas
4,765,662 A 8/1988 Suska
4,824,154 A * 4/1989 Simpson ..... E05C 5/00 292/338
4,831,779 A 5/1989 Kehrli et al.
4,856,830 A 8/1989 Chateau
5,137,327 A 8/1992 Edmonds
5,172,520 A 12/1992 Hostetler et al.
5,188,404 A 2/1993 Orendorff
5,224,297 A 7/1993 Watkins
5,319,882 A 6/1994 Biebuyck
5,326,141 A 7/1994 Gorman
5,349,782 A 9/1994 Yulkowski
5,361,539 A 11/1994 Widener
5,403,047 A 4/1995 Walls
5,409,272 A 4/1995 McCormack
5,465,460 A * 11/1995 Cantone ..... E05C 17/50 16/82
5,465,480 A 11/1995 Karl et al.
5,570,915 A 11/1996 Asadurian
5,660,021 A 8/1997 Wolgamont
5,901,501 A 5/1999 Fountaine
5,927,773 A 7/1999 Larsen et al.
5,931,415 A 8/1999 Lingard et al.
6,185,871 B1 2/2001 Wang
6,286,274 B1 9/2001 Mckann
6,363,832 B1 4/2002 Francis
6,409,234 B1 6/2002 Larsen et al.
6,564,428 B2 5/2003 Richard et al.
7,000,550 B1 2/2006 Mandall
7,182,374 B2 2/2007 Figge et al.
7,578,531 B1 * 8/2009 Leontaridis ..... E05B 65/0835 292/11
7,707,776 B2 5/2010 Weissofner et al.
8,038,184 B2 10/2011 Grigis
8,146,393 B2 4/2012 Katagiri et al.
8,424,931 B2 4/2013 Chang
8,468,746 B2 * 6/2013 Salerno ..... E05B 65/0021 49/199
8,534,000 B1 9/2013 Fadlon
8,627,606 B2 * 1/2014 Salerno ..... E06B 7/20 49/197
8,707,625 B2 4/2014 Raz et al.
8,813,427 B2 8/2014 Meeks
8,925,249 B2 1/2015 Speyer et al.
9,145,719 B2 9/2015 Hartford
9,598,894 B2 3/2017 Raz
9,670,691 B2 6/2017 Mansueto et al.
9,702,168 B2 7/2017 Jadallah et al.
9,970,214 B2 5/2018 Raz
9,988,830 B2 6/2018 Raz
10,138,654 B2 11/2018 Raz
10,221,595 B2 * 3/2019 Ward ..... E05B 63/0052
10,480,213 B2 11/2019 Raz
2002/0095885 A1 7/2002 Sampson
2002/0145292 A1 10/2002 Furner
2002/0163208 A1 11/2002 Quigley
2004/0222649 A1 11/2004 Ito et al.
2005/0001436 A1 1/2005 Ramsauer
2006/0021400 A1 2/2006 Jackson
2007/0113478 A1 5/2007 Chu et al.
2007/0290456 A1 12/2007 Speyer
2008/0129054 A1 6/2008 Tremble et al.
2009/0289065 A1 11/2009 Sampson
2012/0204503 A1 8/2012 Helton
2013/0000205 A1 1/2013 Raz et al.
2014/0190098 A1 7/2014 Raz et al.
2014/0259946 A1 9/2014 Mansueto et al.
2015/0123411 A1 5/2015 Woo
2016/0001643 A1 1/2016 Ichikawa
2016/0032627 A1 2/2016 Yoshino et al.
2016/0076275 A1 3/2016 Uemura et al.
2016/0076280 A1 3/2016 Rudraraju et al.
2016/0083976 A1 3/2016 Rickenbaugh et al.
2017/0152676 A1 6/2017 Raz
2017/0204621 A1 7/2017 Procton et al.
2017/0254119 A1 9/2017 Raz
2018/0209175 A1 7/2018 Raz
2018/0252025 A1 9/2018 Raz
2018/0266153 A1 9/2018 Marsh
2019/0071895 A1 3/2019 Raz

FOREIGN PATENT DOCUMENTS

CA 1029063 4/1978
CN 107923197 4/2018
DE 8900012 9/1953
DE 929692 6/1955
DE 8900012 3/1969
DE 2628036 1/1977
DE 2652562 6/1977
DE 2852670 6/1980
DE 3447796 7/1985
DE 8438238 12/1987
DE 29517077 2/1997
DE 10117173 10/2002
DE 10322798 12/2004
DE 102004054981 8/2007
DE 10329560 6/2012
EP 67075 12/1982
EP 0094461 11/1983
EP 0067075 12/1985
EP 0270437 6/1988
EP 0811738 12/1997
EP 1422368 5/2004
EP 1574657 9/2005
EP 1775403 4/2007
EP 2726688 5/2014
EP 3341542 7/2018
EP 3347557 7/2018

(56) References Cited

FOREIGN PATENT DOCUMENTS

| | | | |
|---|---|---|---|
| FR | 469276 | | 7/1914 |
| FR | 2631068 | | 11/1989 |
| FR | 2844822 | | 3/2004 |
| FR | 2691298 | | 3/2007 |
| GB | 1399058 | A | 6/1975 |
| GB | 2233701 | A | 1/1981 |
| GB | 2154639 | B | 6/1987 |
| GB | 2195958 | A | 4/1988 |
| GB | 2250772 | A | 6/1992 |
| GB | 2521932 | A | 7/2015 |
| WO | 2013001488 | | 1/2013 |
| WO | 2013001488 | A1 | 1/2013 |
| WO | 2013018496 | | 3/2015 |
| WO | 2017033177 | | 3/2017 |
| WO | 2017042799 | | 3/2017 |
| WO | 2017090020 | | 6/2017 |
| WO | 2017149544 | | 9/2017 |
| WO | 2017149545 | | 9/2017 |

* cited by examiner

SECURING MECHANISM FOR A SLIDING PANEL

FIELD OF INVENTION

The presently disclosed subject matter relates to securing mechanism for a sliding panel, in general, and in particular to a securing mechanism for securing a sliding panel of a sliding door or a window.

BACKGROUND

Securing mechanism for a sliding panel are known, for example U.S. Pat. No. 4,062,576 discloses a device which locks the sliding panel against horizontal and vertical movement. The device is secured on one of the upraised walls of the panel track by an eccentric that works in opposition to a support flange. The support flange carries slide stops to prevent the panel from sliding in its track. The vertical movement of the window out of the track is prevented by a lift stop comprising a flat spring secured in the upper track or lift stop elements on the support flange U.S. Pat. No. 4,300,795 discloses an apparatus which includes a lock unit having dual eccentrics that are spring biased toward an opposing planar support flange. The lock unit is mounted so that a selected sidewall of a conventional sliding panel track is squeezed between the eccentrics and the support flange by the force of the spring. Slide stops extend from the support flange into the operative area of the track to prevent horizontal sliding movement of the panel. The apparatus further includes a lift stop which may be used in conjunction with the lock unit to prevent the sliding panel from being lifted clear of the lower track. It comprises a flat spring having a bias toward assuming a U-shaped configuration. The spring legs are spread so that the spring can be inserted into the upper panel track above the panel.

AU199186932 discloses a locking mechanism for sliding sash windows comprises an anchor and a latch. The latch comprises a shaped channel, one limb of which has formed therealong a bead for slidably and pivotally engaging a trailing edge of the sliding sash The channel further comprises a central relief portion within which the anchor seats and, adjacent a bottom surface, a projecting lip which is adapted to engage a step formed on the centre mullion of the window. The anchor comprises a body which is adapted to slidably engage the trailing edge of the sliding sash and which further comprises a bore which receives a locking cylinder from which protrudes a rearwardly facing tab In a first, locked position, the channel is inhibited in pivoting with respect to the anchor owing to an interference between the channel and the tab In a second, unlocked position, the channel is free to pivot with respect to the anchor so that the lip can pivot free of the step so that the sliding sash can be opened or closed. In order for the window to automatically latch when closed, a spring is provided integrally with the channel which biases against a platform on the anchor to bias the channel into the first position

SUMMARY OF INVENTION

There is provided in accordance with an example of the presently disclosed subject matter a sliding door including a panel configured to slide along a path; a holding member transversely disposed with respect to the path in a location along the path, the holding member having a first side portion coupled to a second side portion, the second side portion being spaced apart from the first side portion defining thereby a channel therebetween, the channel being configured for receiving therein at least a segment of the panel, the holding member further including an abutting portion transversely extending inside the channel from the first side portion defining an opening between an edge thereof and the second side portion, the opening being configured to allow sliding of the segment therethrough; and a stop member being displaceable between an engaged state in which a first end of the stop member engages the abutting portion and the first side portion, and a second end of the stop member engages the segment precluding thereby sliding of the panel at least in a direction towards the abutting portion and a disengaged state in which the stop member disengages the segment allowing thereby sliding of the panel towards the abutting portion.

The stop member can be configured such that in the engaged state compressive forces are exerted on the segment and the stop member whereby sliding of the panel towards the abutting portion can be opposed. The path can extend along an opening defined by at least one profile. The holding member can be a longitudinal member integrally formed with the at least one profile.

The stop member can be an elongated rod disposed inside the channel along the length thereof and configured to engage, in the engaged state, at least a portion of the segment. The segment can be an edge of the panel extending along one dimension of the panel, the dimension transversely disposed with respect to the path, and wherein the elongated rod can be configured to engage at least the majority of the edge.

The stop member can include a cross section having a rotational asymmetry configured such that the stop member can be rotated between a first orientation, in which the stop member can be in the disengaged state, and a second orientation, in which the stop member can be in the engaged state. The stop member can be rotatably mounted on a hinge such that an axis of rotation thereof can be in parallel with an axis of the rotational asymmetry.

The stop member can include a rectangular cross section and can be configured to be rotated about an axis between the first orientation and the second orientation, and wherein in the second orientation the rectangular cross section can be disposed in an angle with respect to the panel such that a first end of the rectangular cross section engages the abutting portion and the first side portion while a second end of the rectangular cross section engages the segment of the panel.

The stop member can include an asymmetric oval cross section having a first end configured to abut the abutting portion and the first side portion, and a second end configured to abut the segment. The asymmetric oval cross section can include a circular portion defined at the first end and a protruding portion defined at the second end, the protruding portion being configured to selectively engage the segment. The segment can include an engaging edge having a depression configured to engage the protruding portion. The abutting portion and the first side portion define together a rounded seat configured to rotatably hold therein the circular portion.

The segment can include a shoulder portion facing the stop member and being configured such that in the engaged state a second end of the stop member engages the shoulder portion.

The sliding door can further include a return mechanism bearing against the stop member and being configured to urge the stop member to the engaged state.

The sliding door can further include a handle so disposed with respect to the stop member such that it can be configured for actuating the displacement of the stop member from the engaged state to the disengaged state. The handle can be mounted on the panel adjacent the segment, and can be configured to actuate displacement of the stop member from the engaged state to the disengaged state.

There is provided in accordance with a further aspect of the presently disclosed subject matter a securing mechanism for securing a segment of a panel of a sliding door configured to slide along a path. The securing mechanism including a holding member transversely disposed with respect to the path in a location along the path, the holding member having a first side portion coupled to a second side portion, the second side portion being spaced apart from the first side portion defining thereby a channel therebetween, the channel being configured for receiving therein at least the segment of the panel, the holding member further including an abutting portion transversely extending inside the channel from the first side portion defining an opening between an edge thereof and the second side portion, the opening being configured to allow sliding of the segment therethrough; and a stop member being displaceable between an engaged state in which a first end of the stop member engages the abutting portion and the first side portion and a second end of the stop member can be configured to engage the segment precluding thereby sliding of the panel at least in a direction towards the abutting portion and a disengaged state in which the stop member can be configured to disengage the segment allowing thereby sliding of the panel towards the abutting portion; the stop member can be configured such that in the engaged state compressive forces are exerted on the segment and the stop member whereby sliding of the panel towards the abutting portion can be opposed.

There is provided in accordance with yet another aspect of the presently disclosed subject matter a sliding door comprising: a panel configured to slide along a path; a stop member transversely disposed with respect to the path adjacent a location along the path, the stop member being pivotally mounted on an axis, and being displaceable between an engaged state in which the stop member engages a segment of the panel precluding thereby sliding of the panel and a disengaged state in which the stop member disengages the segment allowing thereby sliding of the panel; wherein the stop member can be configured such that in the engaged state compressive forces are exerted on the segment by the stop member whereby sliding of the panel towards the abutting portion can be opposed.

The stop member can be mounted on the panel and configured to slide therewith along the path; and wherein the sliding door further can include a holding member transversely disposed with respect to the path in a location along the path, the holding member having a first side portion coupled to a second side portion, the second side portion being spaced apart from the first side portion defining thereby a channel therebetween, the channel being configured for receiving therein at least the segment of the panel, the holding member further including an abutting portion transversely extending inside the channel from the first side portion defining an opening between an edge thereof and the second side portion, the opening being configured to allow sliding of the segment therethrough; and wherein in the engaged state first end of the stop member engages the abutting portion and the first side portion and a second end of the stop member engages the segment precluding thereby sliding of the panel at least in a direction towards the abutting portion, and wherein in the disengaged state the stop member can be configured to disengage the segment allowing thereby sliding of the panel towards the abutting portion.

BRIEF DESCRIPTION OF THE DRAWINGS

In order to understand the disclosure and to see how it may be carried out in practice, embodiments will now be described, by way of non-limiting examples only, with reference to the accompanying drawings, in which.

DETAILED DESCRIPTION OF EMBODIMENTS

Figure 1:
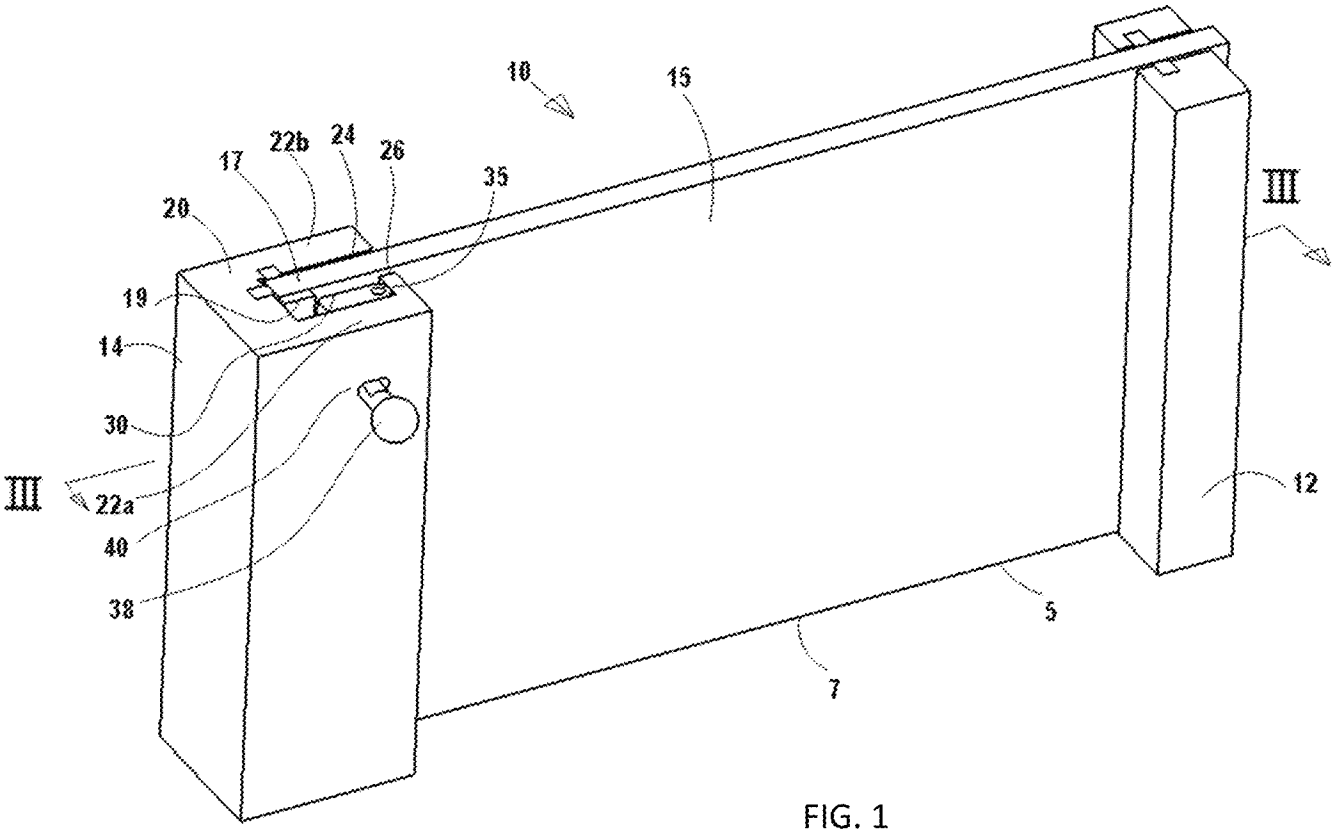
FIG. 1 is a perspective view of a sliding panel having a securing mechanism in accordance with an example of the presently disclosed subject matter.

FIG. 1 shows a sliding door 10 for closing an opening 5, defined between a first profile 12 and a second profile 14. According to the illustrated example the first and second profiles 12 and 14, are vertically disposed with respect to the opening 5. The sliding door 10 includes a panel 15 configured to slide along a path 7 defined between the first profile 12 and the second profile 14.

It is appreciated that according to other examples the opening can be defined between two wall portions, as opposed to two profiles. In addition, the sliding door 10 can be configured to slide along a path 7 which is not defined at an opening, rather the path can be defined between two points, such that the panel 15 can be slide to de disposed between the two points, precluding thereby crossing through the area defined by path.

According to a further example, the sliding door 10 can include two panels extending along a path on an opening having a first side profile one on side thereof and a second side profile on another side thereof. The panels can be disposed to slide along the opening as a side-by-side sliding window. According to this example, each panel can be configured to abut against one side profile while the opposing edge of the panel is disposed adjacent the other panel.

The sliding door 10 further includes a holding member 20 which can be a longitudinal member having a first side portion 22*a* coupled to a second side portion 22*b* and being spaced apart from the first side portion 22*a* defining thereby a channel 24 therebetween. The channel 24 is configured for receiving therein at least a segment 17 of the panel 15.

The holding member 20 is transversely disposed with respect to the path 7 in a location along path 7. That is to say, if, for example, the path 7 substantially horizontally extends along a doorway, and the panel 15 is configured to close the doorway by selectively sliding rightward and leftward, the holding member 20 is substantially vertically disposed at any point along the path 7. The holding member 20 is so disposed along the path such that when the panel 15 slid and reaches the holding member 20 a segment 17 thereof slides through the channel 24. The holding member 20 can extend along the height of the panel, such that substantially the entire edge segment of the panel 15 can be disposed inside the channel 24.

According to the illustrated example, the holding member 20 is integrally formed with the second profile 14, such that the holding member 20 is disposed adjacent the edge of the path 7, i.e. the jamb of the doorway.

According to other examples, however, the holding member 20 can be disposed at any other location along the path 7, such as adjacent the first profile 12, or spaced apart from the first or second profiles 12 and 14.

According to other examples, the path 7 can extend vertically, for example along an opening of a window, and the panel 15 can be configured to close the opening, by selectively sliding upwardly and downwardly, such as a vertical sliding window. According to this example, the holding member 20 can be substantially horizontally disposed at any point along the path 7. Similar to the previous example, the holding member 20 is so disposed along the vertical path such that when the panel 15 slides and reaches the holding member 20 a segment 17 thereof slides through the channel 24.

According to this example, the first profile 12 is mounted at the top of the opening of the vertical sliding window while the second profile 14 is mounted at the bottom of the opening of the vertical sliding window. The holding member 20 can be coupled to the second profile 14, such that the holding member 20 is disposed adjacent the edge of the path 7, i.e. the bottom of the window.

It is noted that in this example, the holding member 20 can extend along the width of the panel 15, such that substantially the entire edge segment of the panel 15 can be disposed inside the channel 24.

Figure 2A:
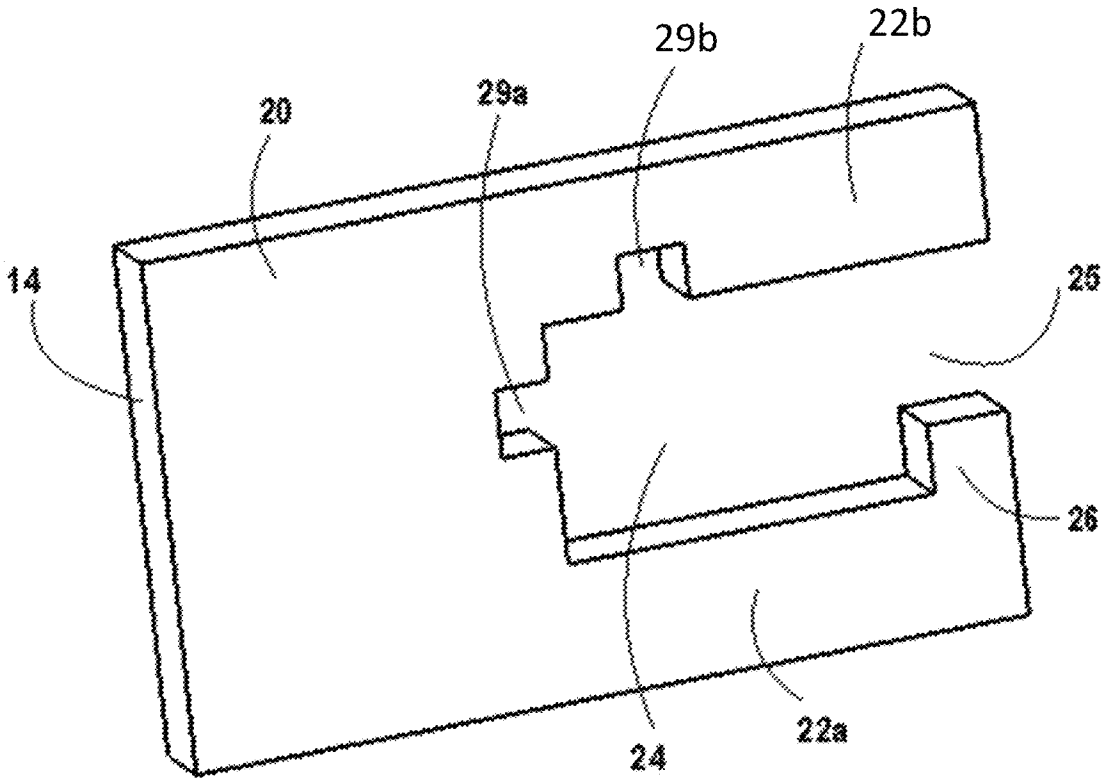
FIG. 2A is a top view of the side profile of the sliding panel of FIG. 1.

As can best be seen in FIG. 2A, the holding member 20 further includes an abutting portion 26 transversely extending inside the channel 24 from the first side portion 22*a* defining an opening 25 between an edge thereof and the second side portion 22*b*. The opening 25 is configured to allow sliding of the segment 17 therethrough into the channel 24.

It is appreciated that in case the holding member 20 is mounted away from the first and second profiles 12 and 14 the opening 25 and channel 24 are configured such that the panel 15 can be slid therethrough from the first profile 12 towards the second profile 14 and vice versa. Thus the width of the opening 25, i.e. the distance between the edge of the abutting portion 26 and the second side portion 22*b*, is configured to allow sliding the panel therethrough.

The sliding door 10 further includes a stop member 30 disposed in the channel 24 such that it engages the abutting portion 26 and the first side portion 22*a*.

Figure 3A:
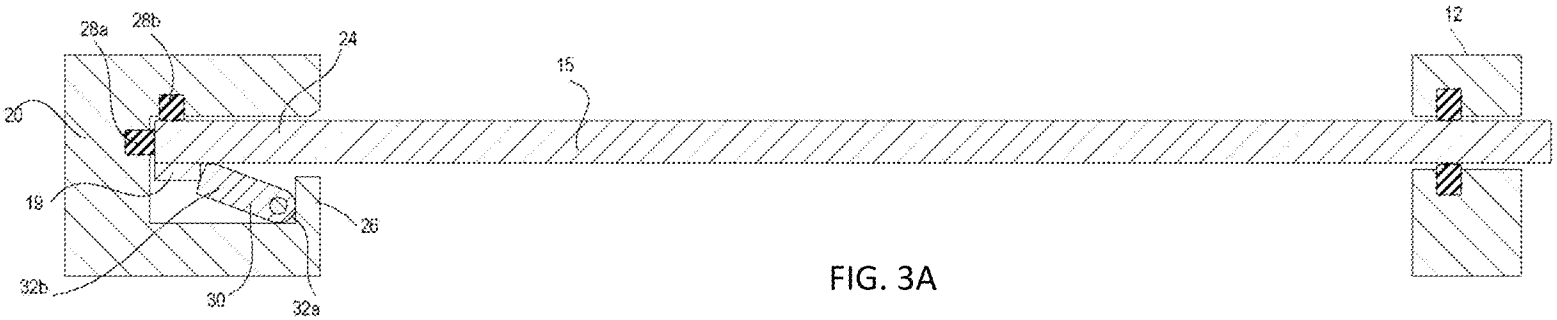
FIG. 3A is a sectional view of the sliding panel of FIG. 1 taken along line III-III, wherein the securing mechanism is in the secured position thereof.

In the present example the segment is an edge of the panel extending along one dimension of the panel, for example the height thereof. The dimension is transversely disposed with respect to the path. Similarly the holding member 20 and the channel 24 extend along the height of the panel 15, thus, the stop member 30 can be an elongated rod disposed inside the channel 24 along the length thereof. The stop member 30 can thus be configured to engage the majority or the entire length of the abutting portion 26 and the first side portion 22*a*. As shown in FIGS. 2A and 3A, the second profile 14 includes a sealing element 28*a* which can be disposed in a groove 29*a* (best seen in FIG. 2A) defined inside the channel 24. The groove 29*a* is defined such that the sealing element 28*a* is aligned with the path 7 along which the panel 15 slides. This way, the edge of the panel 15 is configured to abut the sealing element 28*a*, precluding air flow therebetween. Similarly, the second side portion 22*b* includes a sealing element 28*b* which can be disposed in a groove 29*b* defined inside the channel 24 and being configured to abut the face of the segment of the panel 15.

Figure 2B:
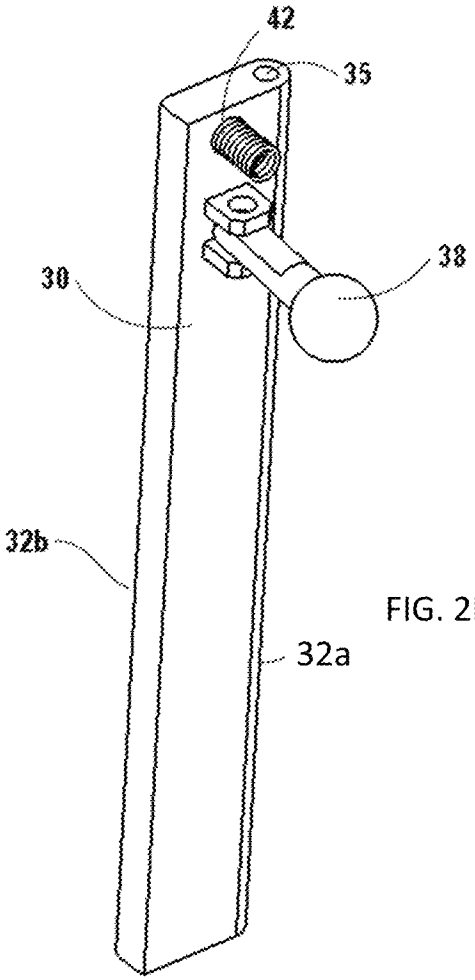
FIG. 2B is a perspective view of stop member of the securing mechanism of FIG. 1.

It is appreciated that the sealing elements 28*a* and 28*b* can be replaced with shock absorbing members, or can be configured to provide sealing and shock absorbent properties, disposed inside the grooves 29*a* and 29*b*. The shock absorbing element can be disposed in the groove 29*a* (best seen in FIG. 2A) such that the shock absorbing element is aligned with the path 7 along which the panel 15 slides. This way, the edge of the panel 15 is configured to abut the shock absorbing element 28*a*, providing protection thereto. Similarly, the second side portion 22*b* can include a shock absorbing element which can be disposed in a groove 29*b* defined inside the channel 24, configured to abut the face of the segment of the panel 15. As shown in FIG. 2B, the stop member 30 according to the illustrated example has a rectangular cross section having a first end 32*a* configured to abut the abutting portion 26 and the first side portion 22*a*, and a second end 32*b* configured to abut the segment 17 of the panel 15.

Figure 3B:
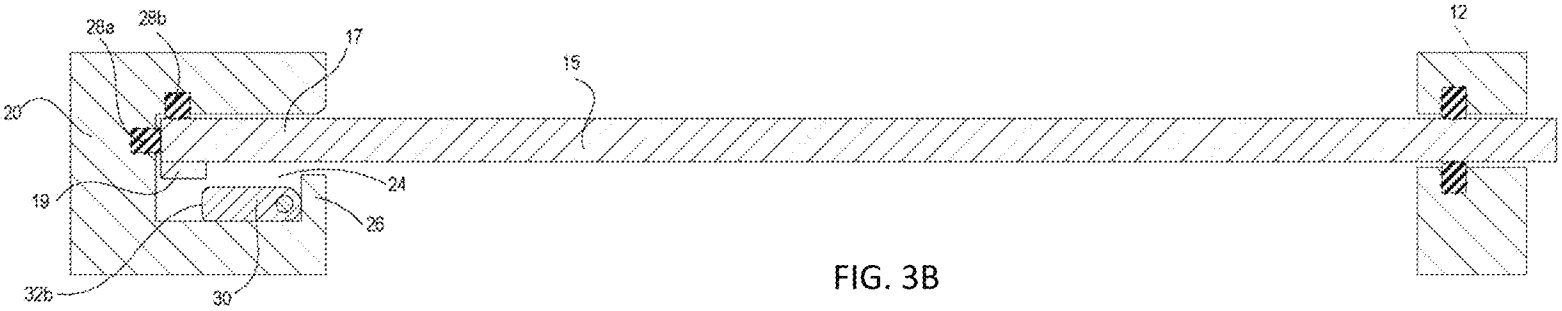
FIG. 3B is a sectional view of the sliding panel of FIG. 1 taken along line III-III, wherein the securing mechanism is in the released position thereof.
Figure 3C:
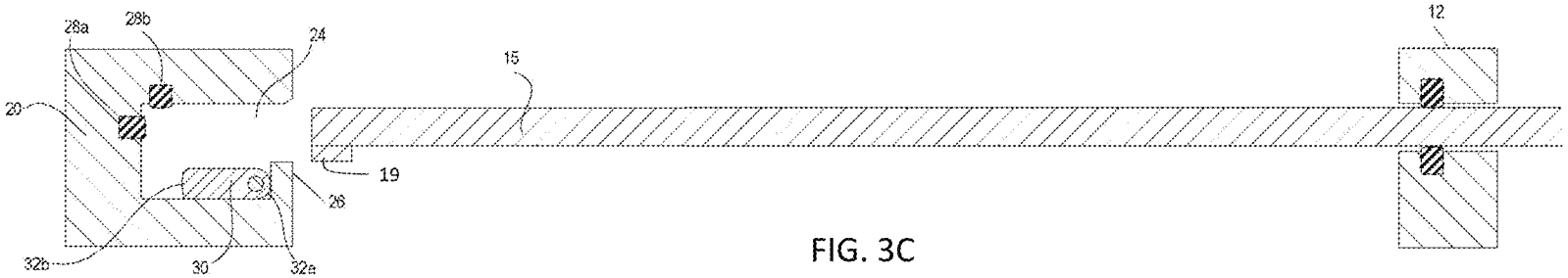
FIG. 3C is a sectional view of the sliding panel of FIG. 1 taken along line III-III, wherein the panel is in the open position thereof.
Figure 4A:
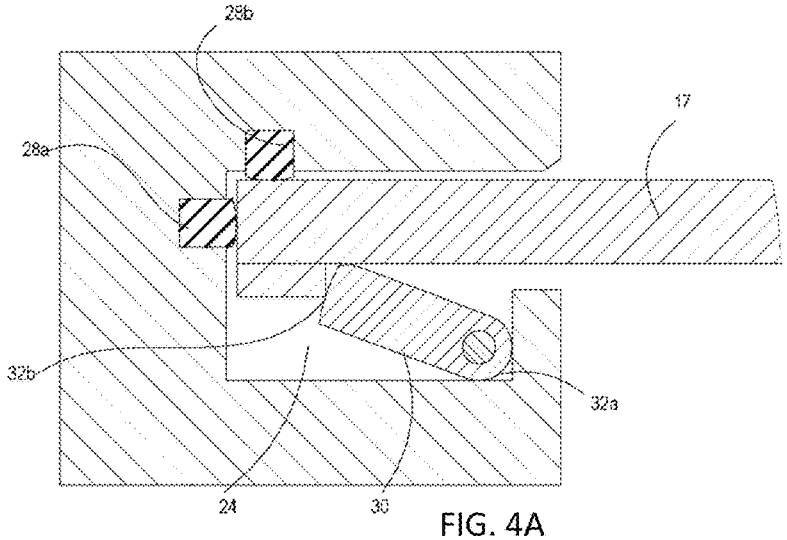
FIG. 4A is an enlarged view of the holding member of FIG. 3A.
Figure 4B:
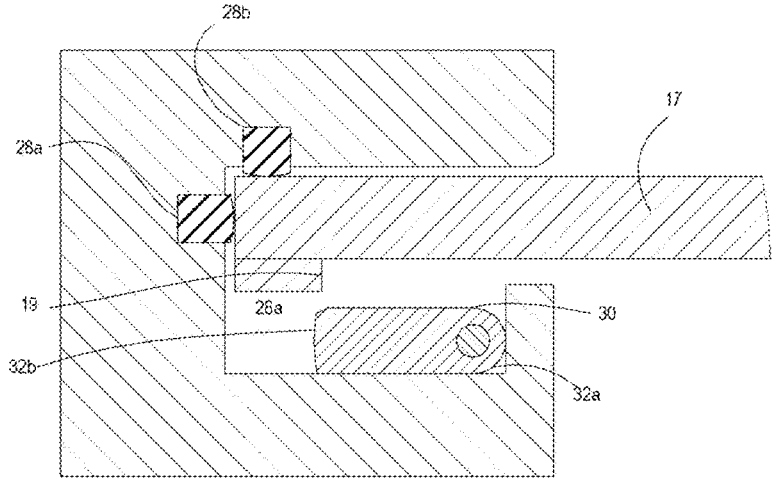
FIG. 4B is an enlarged view of the holding member of FIG. 3B.

Attention is now made to FIGS. 3A through 4C, the stop member 30 is displaceable within the channel 24 between an engaged state in which the second end 32*b* of stop member 30 engages the segment 17 of the channel 15 (FIGS. 3A and 4A) and a disengaged state in which the second end 32*b* of the stop member 30 disengages the segment 17 (FIGS. 3B and 4B).

In the illustrated example, the rectangular stop member 30 is configured to be rotated about an axis between the disengaged states and the engaged state. Accordingly, in the disengaged state, as shown in FIG. 3B the rectangular cross section of the stop member 30 is disposed substantially in parallel to the segment 17, such that the edge segment 17 of the panel 15 can slide inside or through the channel 24. In the engaged state, however, the rectangular cross section of the stop member 30 is disposed in an angle with respect to the panel 15 such that the first end 32*a* thereof engages the abutting portion 26 and the first side portion 22*a*, while the second end 32*b* thereof engages the segment 17 of the panel 15.

According to this example, the edge segment 17 of the panel can include a shoulder portion 19 protruding from the surface of the panel 15 towards the stop member 30. The shoulder portion 19 is configured such that in the engaged state of the stop member 30, the second end 32*b* thereof engages the segment 17 and the shoulder portion 19. The stop member 30 is thus configured such that in the engaged state compressive forces are exerted on the segment 17 and the shoulder portion 19 and the stop member 30. The compressive forces according to this example are formed in the engaged state between the corner of the first side portion 22*a* and the abutting portion 26, on one hand and the second side portion 22*b* on the other hand, while a segment of the panel 15 and the stop member 30 are securely held therebetween.

Figure 4C:
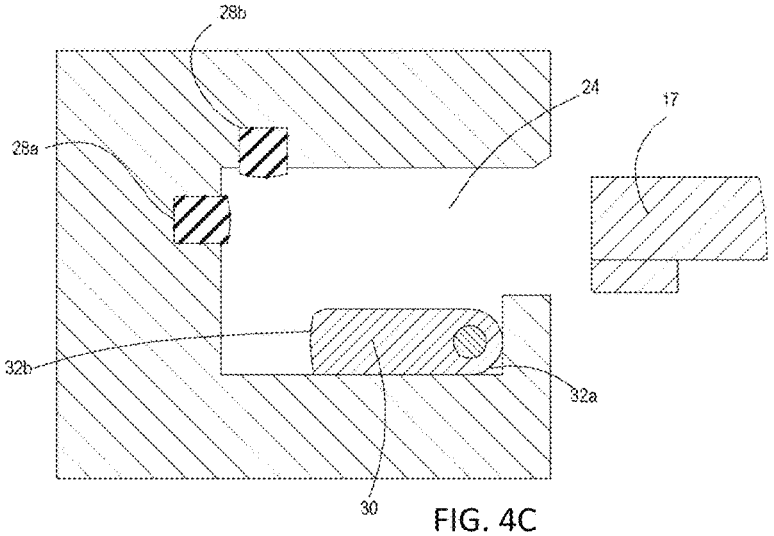
FIG. 4C is an enlarged view of the holding member of FIG. 3C.

As a result, in the engaged state sliding of the panel 15 towards the abutting portion 26 is opposed, such that the securing mechanism is in the secured position and the panel is locked in place. In this position, the segment 17 which is pushed by the stop member 30 towards the second side portion 22*b* can abut the sealing element 28*b* on the second side portion 22*b*. In the disengaged state however, the securing mechanism is released and the panel is free to slide towards the abutting portion 26 and out of the channel 24, and consequently to the open position of the door, as shown in FIGS. 3C and 4C.

It is appreciated that displacement of the stop member 30 between an engaged and disengaged states can be a rotation thereof about a fixed axis, as in the present example, or otherwise the displacement can be a lateral movement thereof. It is further appreciated that in the case of a rotational displacement, the stop member includes a cross section having a rotational asymmetry. The rotational asymmetry is configured such the stop member 30 can be rotated between a first and a second orientations. In the first orientation of the stop member a portion thereof engages the segment of the panel, while in a second orientation of the stop member it disengages the panel.

It is appreciated that either in the example of a lateral displacement of the stop member 30 or in the example of a rotational displacement thereof, the abutting portion 26 and the first side portion 22*b* are configured such that stop member 30 maintains an engagement therewith at least in the engaged state. This way, in the engaged state the stop member 30 and the segment 17 of the panel 15 are compressed between the first side portion 22*a* and the abutting portion 26, on one hand and the second side portion 22*b* on the other hand.

As indicated hereinabove, in the present example the holding member 20, the channel 24, and the stop member 30 extend along the height of the panel 15, such that the stop member 30 engages the entire height of the panel, or at least large portions thereof. It is appreciated that engaging large portion of the panel facilitate securing thereof in place, without exerting major forces in one location, i.e the forces exerted on the panel are spread along portions of the height thereof.

The stop member 30, according to the example of FIG. 1, can be pivotally mounted on a hinge 35 disposed close the first end 32*a* thereof and secured to the holding member 20 adjacent the corner of the abutting portion 26 and the first side portion 22*a*. The hinge 35 facilitate the rotation of the stop member 30 between the engaged and disengaged states.

It is appreciated that according to other examples the hinge 35 can be mounted elsewhere inside the channel 24 so long as the stop member 30 can be rotated between the engaged in which sliding of the panel 15 towards the abutting portion 26 is opposed, and a disengaged states in which the panel is free to slide towards the abutting portion 26 and out of the channel 24.

It is appreciated that the axis of rotation of the stop member 30 can be defined away from the first end 32*a* thereof, so long as the engaged and disengaged states are maintained as described herein above.

Displacement of the stop member 30 between the engaged and disengaged states can be carried out by a handle 38 coupled thereto. The handle 38 can be configured to protrude out of the channel 24 through a bore 40 facilitating thereby displacement of the stop member 30. According to the example illustrated in FIG. 2B, the handle 38 is mounted to the stop member 30 in close proximity to the second end 32*b* thereof while the hinge 35 is mounted in close proximity to the first end 32*a* thereof. This way, rotation of the stop member 30 about the hinge 35 is facilitated by the handle 38.

The stop member 30 can be further provided with return mechanism, such as a spring 42 configured to urge the stop member 30 to be normally disposed at the engaged state thereof. The spring 42 is configured such that one end thereof bears against the inner surface of the first side portion 22*a*, while the opposing end thereof bears against the stop member 30.

This way, the panel 15 can be slide along the path 7 such that the edge segment 17 thereof is inserted into the channel 24. The edge of the panel 15 engage the stop member 30 which is urged to the engaged state thereof, i.e. is disposed in diagonal inside the channel, having an angle with respect to the panel 15. Thus, the shoulder portion 19 at the edge segment 17 of the panel IS pushes the stop member 30 towards the first side portion 22*a*, against the force exerted by the spring 42. Once the edge segment 17 with the shoulder portion 19 are fully inserted inside the channel 24, passed the second end 32*b*, the stop member 30 is free to be urged back by the spring to the enraged position thereof. At this position the panel 15 is secured by the stop member 30 and cannot be slid in the direction towards the opening 25 of the channel. This way, in a case of a sliding door, the door is closed and locked. Unlocking the door can be carried out by pulling the handle 38 through the bore 40 overcoming the forces exerted by the spring 42 and displacing the stop member 30 to the disengage state thereof. This way the shoulder portion 19 and the edge segment 17 are no longer engaged by the second end 32*b*, the stop member 30, and the panel is free to be slid towards the first profile, i.e. opening the door or the window.

Reference is now made to FIG. 5, showing a sliding door 50 having a stop member in accordance with another example of the presently disclosed subject matter. The sliding door 50, for which the same elements as in the previous example are designated with the same reference numerals, is configured for closing an opening 55, such as a window, defined between a first profile 52 and a second profile 54. According to the illustrated example the opening further includes a bottom profile 56 disposed between the bottom edge of the first profile 52 and the bottom edge of the second profile 54. The bottom profile 56 defines a path 57 along which the panel 15 can slide. The path 57, according to the present example, is an elongated groove defined in the bottom profile 56 and extending between the first profile 52 and a second profile 54 such that the panel 15 can slide therein.

The sliding door 50 further includes a holding member 20 which can be identical to the one shown in FIGS. 1 and 2A, and can be a longitudinal member integrally formed with the second profile 54, and can include a first side portion 22*a* coupled to a second side portion 22*b* and being spaced apart from the first side portion 22*a* defining thereby a channel 24 therebetween. The channel 24 is configured for receiving therein at least a segment 17 of the panel 15, which according to the present example can be provided without a shoulder portion.

As in the previous example, the holding member 20 further includes an abutting portion 26 transversely extending inside the channel 24 from the first side portion 22*a* defining an opening 25 between an edge thereof and the second side portion 22*b*. The opening 25 is configured to allow sliding of the segment 17 therethrough into the channel 24.

The sliding door 50 further includes a stop member 60 disposed in the channel 24 such that it engages the abutting portion 26 and the first side portion 22*a*.

Figure 5A:
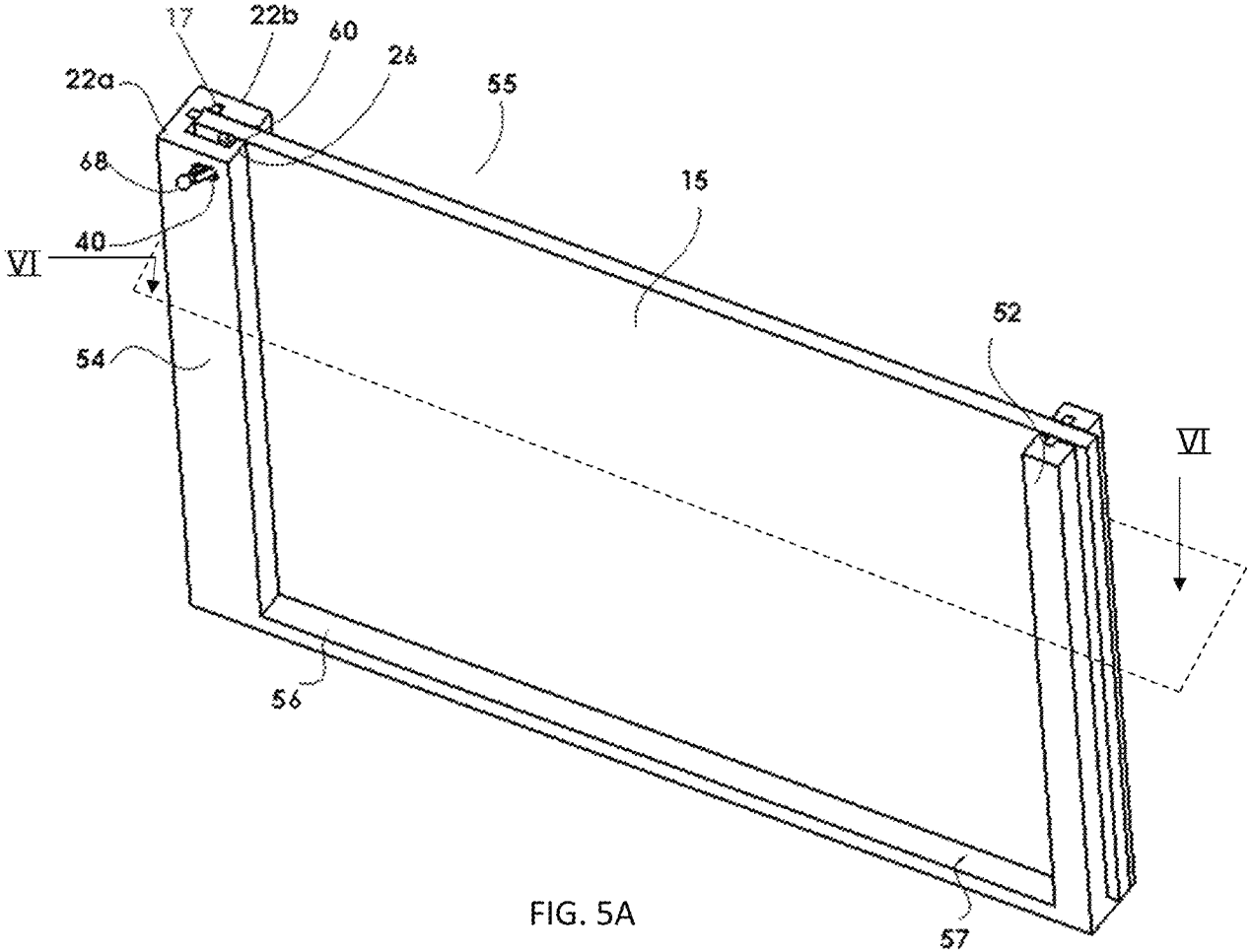
FIG. 5A is a perspective view of a sliding panel having a securing mechanism in accordance with another example of the presently disclosed subject matter.
Figure 5B:
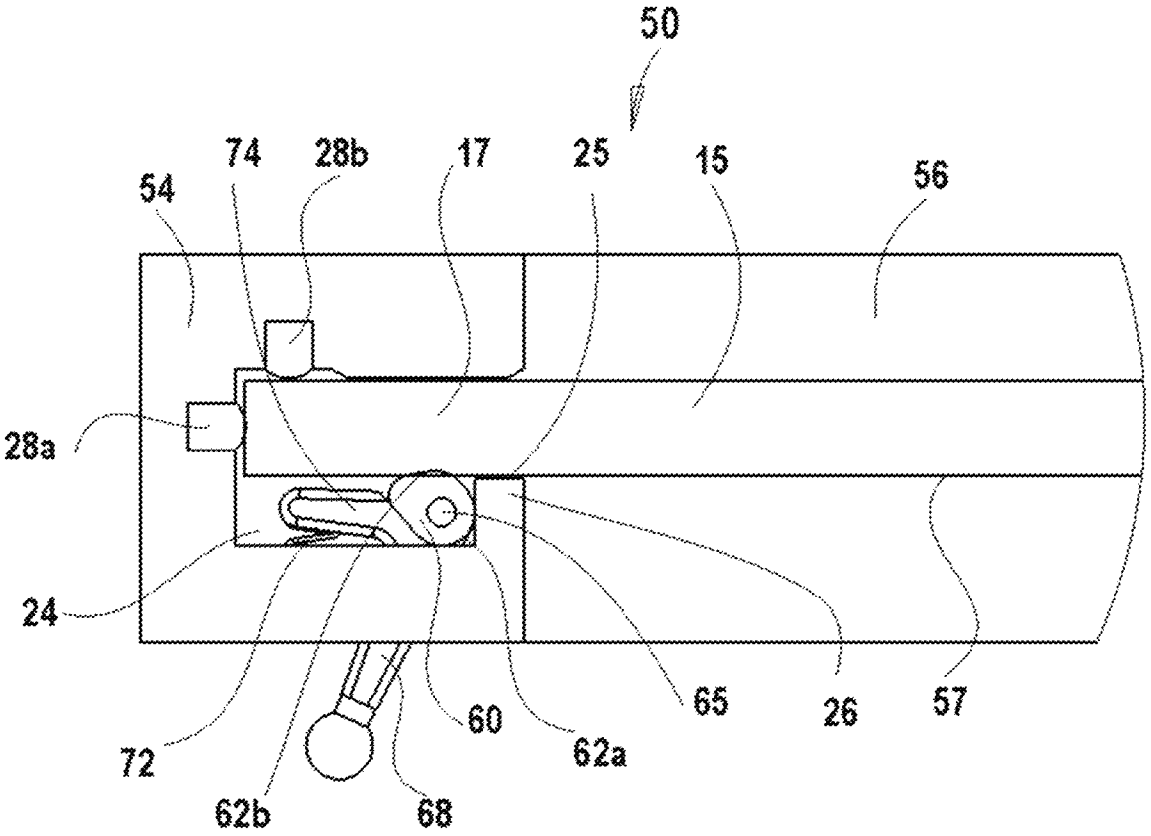
FIG. 5B is a top view of the sliding panel of FIG. 5A.
Figure 5C:
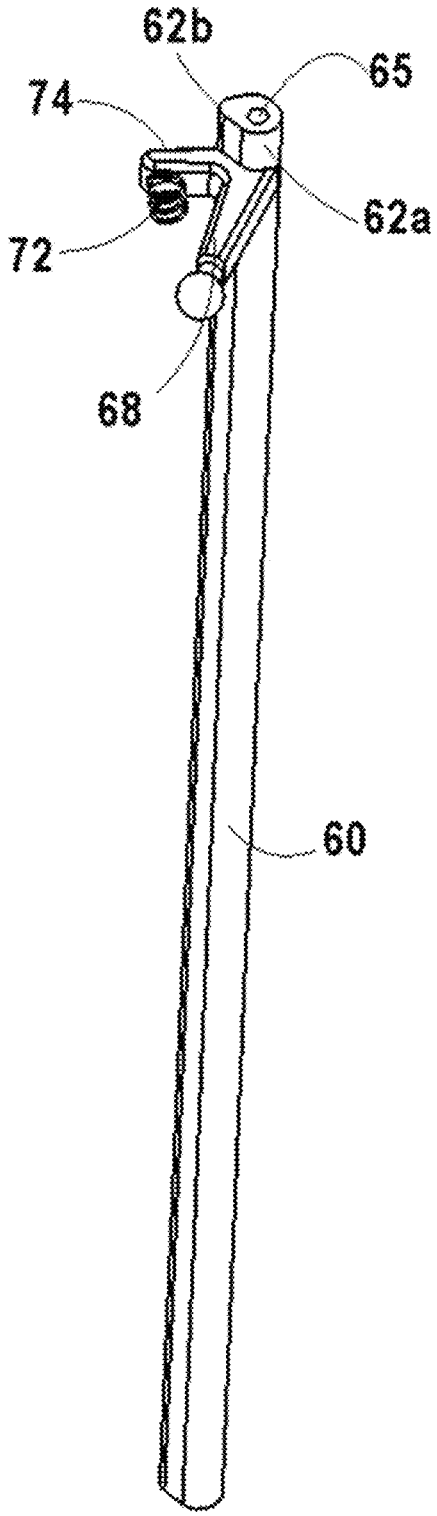
FIG. 5C is a perspective view of stop member of the securing mechanism of FIG. 5A.

As shown in FIGS. 5B and 5C, the stop member 60 according to the illustrated example has an asymmetric oval cross section having a first end 62*a* configured to abut the abutting portion 26 and the first side portion 22*a*, and a variable radius profile 61 extending to a second end 62*b* configured to abut the segment 17 of the panel 15. The asymmetric oval cross section of the stop member 60 has a rotational asymmetry which is configured such the stop member 60 can be rotated between a first and a second orientations. In the first orientation of the stop member 60, the variable radius profile 61 extending to the second end 62*b* of the stop member is configured to engage the segment 17 of the panel 15 located between the edge of a major surface of the panel and the center of the major surface of the panel, while in a second orientation of the stop member 60 it is configured to disengage from the panel.

According to the illustrated example the asymmetric oval cross section includes a circular portion defined first end 62*a* of the stop member 60 and a protruding portion defined at the second end 62*b*. The protruding portion is configured to selectively engage the segment 17 of the panel 15.

The stop member 60, according to the present example, is pivotally mounted on a hinge 65 disposed close to the first end 62*a* thereof, and secured to the holding member 20 adjacent the corner of the abutting portion 26 and the first side portion 22*a*. It is appreciated that the hinge 65 is mounted such that the axis of rotation thereof is in parallel with an axis with respect to which the cross section of the stop member 60 has a rotational asymmetry. For example, the hinge 65 can be mounted at the center of the circular portion defined at the first end 62*a* of the stop member 60. The hinge 65, thus, facilitate the rotational displacement of the stop member 60, and selectively shifts the protruding portion defined on the second end 62*b* thereof between the engaged and disengaged states.

As shown in FIGS. 5A and 5B, the second profile 54 and the second side portion 22*b* can include sealing element 28*a* and 28*b* which, as in the previous example, can be disposed in grooves 29*a* and 29*b* defined inside the channel 24.

As in the previous example, the holding member 20 and the channel 24 can extend along the height of the panel 15, thus, the stop member 60 can be an elongated rod disposed inside the channel 24 along the length thereof. The stop member 60 can thus be configured to engage the entire length of the abutting portion 26 and the first side portion 22*a*.

As in the previous example, the displacement of the stop member 60 between the engaged and disengaged states can be carried out by a handle 68 coupled thereto. The handle 68 can be configured to protrude out of the channel 24 through an elongated bore 40 facilitating thereby displacement of the stop member 60. According to the illustrated example the handle 68 is coupled to the first end 62*a*, i.e. the circular portion of the stop member 60. This way sideward displacement of the handle 68 through the elongated bore 40 causes the rotation of the stop member 60 about the hinge 65 such that the second end 62*b* is selectively shifted between the engaging state and the disengaging state.

The stop member 60 can be further provided with return mechanism, such as a spring 72 configured to urge the stop member 60 to be normally disposed at the engaged state thereof. The spring 72 is configured such that one end thereof bears against the inner surface of the first side portion 22*a*, while the opposing end thereof bears against a bearing protrusion 74 extending from the stop member 30.

It is appreciated that the handle according to another example, can be mounted on the panel and can be configured to actuate the displacement of the stop member. For example, the handle can be configured to displace the stop member to the disengaged state thereof such that the panel can be slid. According to an example, the handle can be configured such that actuation of the stop member is carried out by pulling the handle in the sliding direction of the panel along the path. For example, the handle can be configured to be pulled in the same direction as the sliding of the panel when the sliding door is opened.

Figure 6A:
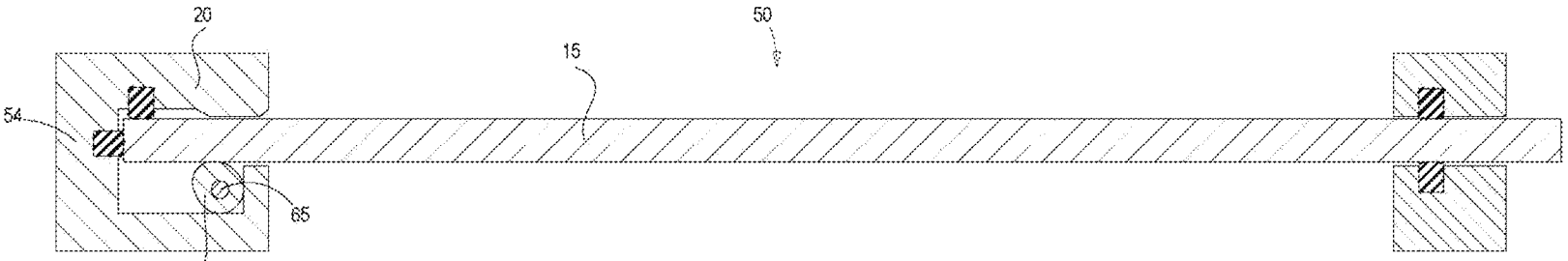
FIG. 6A is a sectional view of the sliding panel of FIG. 5A taken on plane VI-VI, wherein the securing mechanism is in the secured position thereof.
Figure 6B:
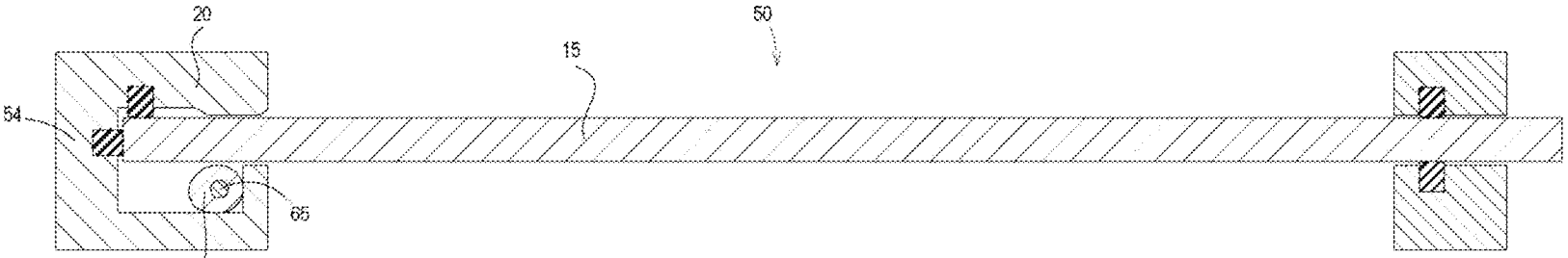
FIG. 6B is a sectional view of the sliding panel of FIG. 5A taken on plane VI-VI, wherein the securing mechanism is in the released position thereof.
Figure 6C:
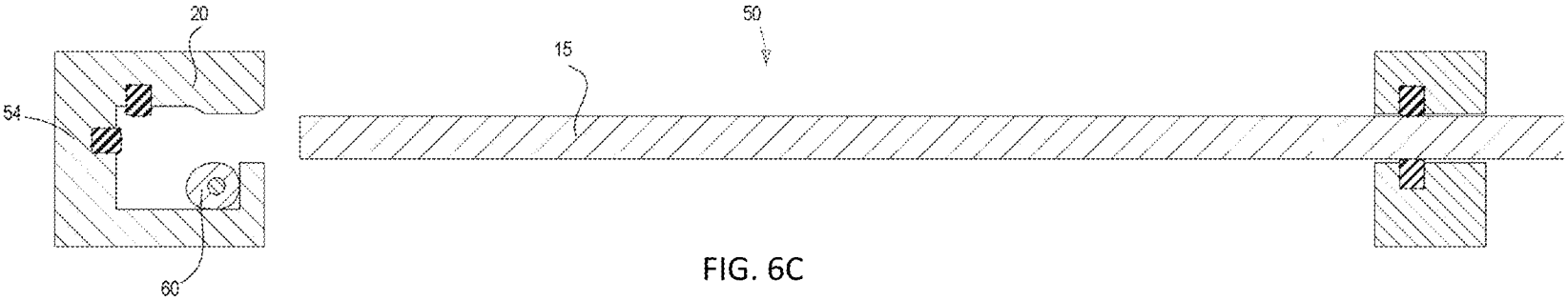
FIG. 6C is a sectional view of the sliding panel of FIG. 5A taken on plane VI-VI, wherein the panel is in the open position thereof.
Figure 7A:
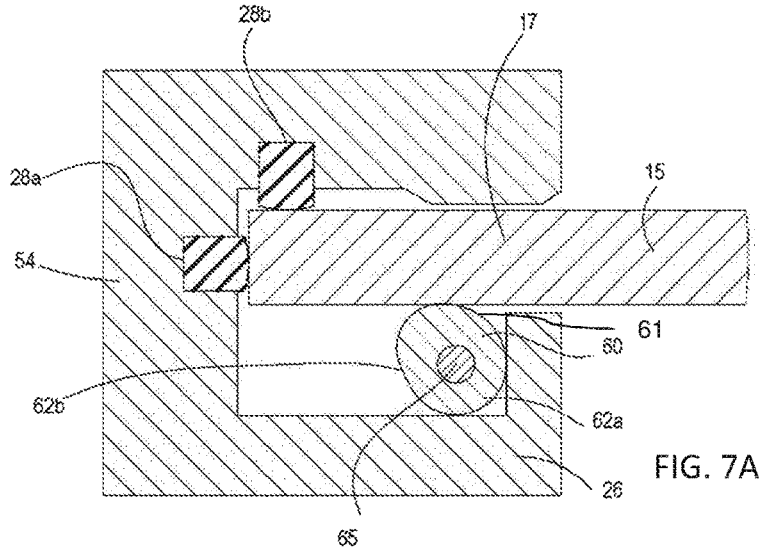
FIG. 7A is an enlarged view of the holding member of FIG. 6A.
Figure 7B:
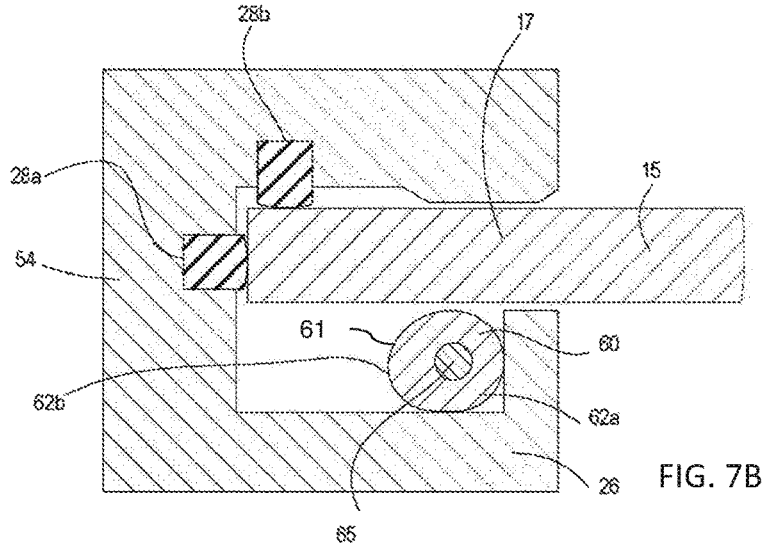
FIG. 7B is an enlarged view of the holding member of FIG. 6B.

Attention is now made to FIGS. 6A through 7C, the stop member 60 is displaceable within the channel 24 between an engaged state in which the protruding portion at the second end 62*b* of stop member 60 engages the segment 17 of the channel 15 (FIGS. 6A and 7A) and a disengaged state in which the protruding portion at the second end 62*b* of stop member 60 disengages the segment 17 (FIGS. 6B and 7B).

Figure 7C:
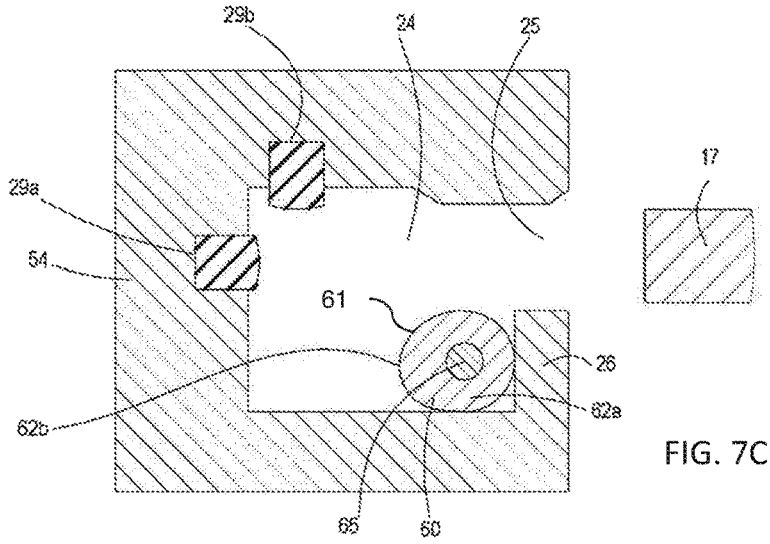
FIG. 7C is an enlarged view of the holding member of FIG. 6C.

As a result, in the engaged state sliding of the panel 15 towards the abutting portion 26 is opposed, such that the panel is locked in place. In this position, the segment 17 which is urged by the protruding portion at the second end 62*b* of the stop member 60 towards the second side portion 22*b* can abut the shock absorbing element 28*b* on the second side portion 22*b*. In the disengaged state however the panel is free to slide towards the abutting portion 26 and out of the channel 24, as shown in FIGS. 6C and 7C.

Figure 8A:
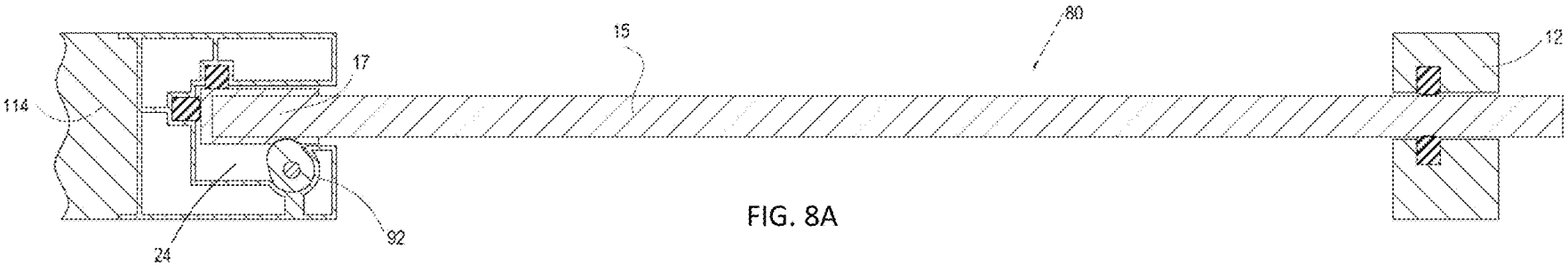
FIG. 8A is a top sectional view of a sliding panel having a securing mechanism in accordance with yet another example of the presently disclosed subject matter.

FIG. 8A shows a sliding door 80 having a securing mechanism in accordance with another example of the presently disclosed subject matter. The sliding door 80, for which the same elements as in the previous examples are designated with the same reference numerals, is configured for closing an opening, such as a window, defined between a first profile 12 and a second profile 114. A panel 15 is slidably mounted between first profile 12 and a second profile 114.

As in the sliding doors of the previous examples, the sliding door 80 further includes a holding member coupled to the second profile 114 having a first side portion 82*a* coupled to a second side portion 82*b* and being spaced apart from the first side portion 82*a* defining thereby a channel 24 therebetween. The channel 24 is configured for receiving therein at least a segment 17 of the panel 15. According to the present example, the segment 17 is provided with an engaging edge 90, here illustrated as a U-shaped portion configured to allow insertion of the edge segment 17 of the profile 15 therein.

As in the previous example, the holding member 20 further includes an abutting portion 86 transversely extending inside the channel 24 from the first side portion 82*a* defining an opening between an edge thereof and the second side portion 82*b*. The opening is configured to allow sliding of the segment 17 therethrough into the channel 24.

According to the present example, the abutting portion 86 and the first side portion 82*a* define together a rounded seat 88. The rounded seat is configured to hold therein a stop member 92 which can be the same as the one shown in FIGS. 5B and 5C, i.e. having an asymmetric oval cross section. The stop member 92 can thus include a circular portion 94*a* defined at a first end thereof and a protruding portion 94*b* defined at the second end thereof. The circular portion 94*a* is configured to be rotatably disposed inside the seat 88, while the protruding portion 94*b* protrude out of the seat 88. That is to say, the seat is configured with a shape substantially conforming the outer counter of the circular portion 94*a* facilitating thereby the rotational displacement of the stop member therein.

Figure 8B:
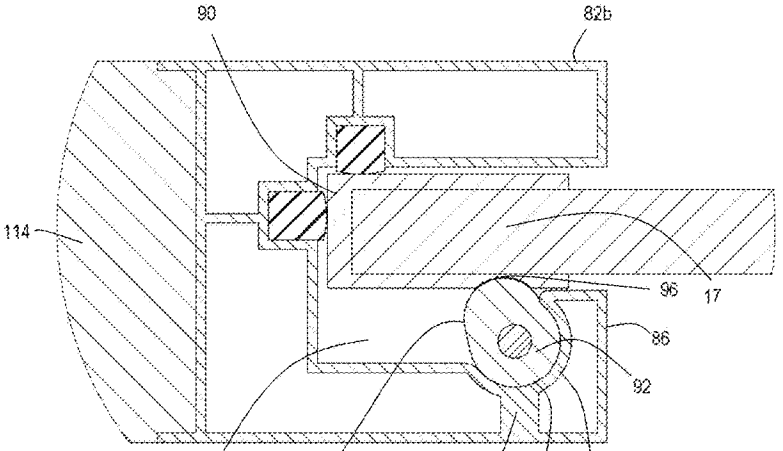
FIG. 8B is an enlarged view of the holding member of FIG. 8A in the secured position thereof.
Figure 8C:
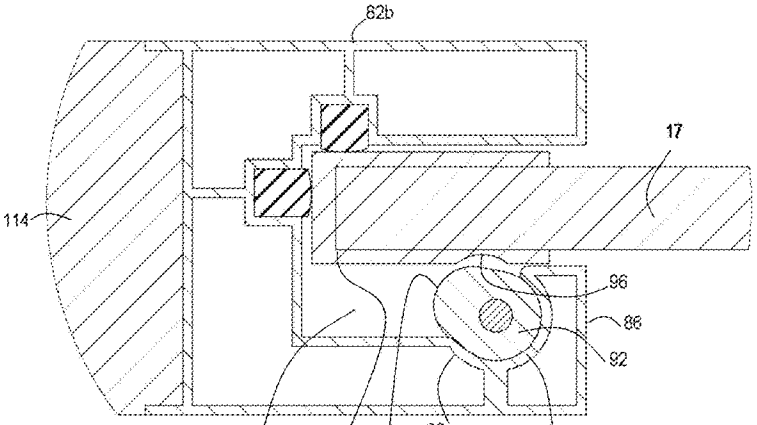
FIG. 8C is an enlarged view of the holding member of FIG. 8A, is in the released position thereof.

The protruding portion 94*b* is configured to selectively protrude out of the seat 88 in a direction towards the edge segment 17 of the panel 15 or slightly away from the edge segment 17, this way the stop member 92 is selectively shifted between an engaged and disengaged states, as illustrated in FIGS. 8B and 8C respectively.

According to the present example, the engaging edge 90 includes a depression 96 configured to engage the protruding portion 94*b* in the engaged state thereof. The depression 96 can be configured to further oppose sliding the segment 17 of the panel 15 out of the channel 24. That is to say the depression 96 can be configured to cooperate with the compression forces acting on the panel such that in the engaged state of the stop member the panel 15 is maintained with the segment 17 locked inside the channel 24.

According to another example the stop member can be transversely disposed with respect to the path adjacent a location along the path without a holding portion. For example, the stop member can be pivotally mounted on a hinge extending between a top profile and a bottom profile of a window. The stop member can thus be displaceable between an engaged state in which the stop member engages a segment of the panel precluding thereby sliding of the panel and a disengaged state in which the stop member disengages the segment allowing thereby sliding of the panel.

Those skilled in the art to which the presently disclosed subject matter pertains will readily appreciate that numerous changes, variations, and modifications can be made without departing from the scope of the invention, mutatis mutandis.

The invention claimed is:

1. A sliding closure for selectively closing an opening comprising:

a panel mounted relative to the opening so as to be slidable between an open position and a closed position along a path extending across at least part of the opening in a direction parallel to a plane of said panel, said plane extending through a majority of said panel and said panel having an external surface extending parallel to the plane of the panel from a leading edge of said panel to a trailing edge of said panel and from a top edge of said panel to a bottom edge of said panel;

an abutment surface disposed in a fixed relation to said path; and a stop member rotatably supported about an axis of rotation, said stop member being rotatable when said panel is in said closed position between an engaged state in which said stop member is interposed between said abutment surface and a region of said panel so as to engage said abutment surface and said region of said panel to prevent sliding of said panel along said path from said closed position towards said open position and a disengaged state in which said stop member allows sliding of said panel along said path, wherein said stop member is configured such that, in said engaged state, sliding of said panel along said path from said closed position towards said open position is opposed by said stop member on which compressive forces are exerted by said region of said panel and said abutment surface, and wherein said region of said panel comprises a portion of said external surface.

2. The sliding closure according to claim 1, wherein the opening is at least partly bounded by a frame, and wherein said abutment surface comprises a surface of an elongated member of said frame.

3. The sliding closure according to claim 1, wherein said stop member is an elongated element.

4. The sliding closure according to claim 1, further comprising a return mechanism bearing against said stop member such that, when the panel is in the closed position, said return mechanism urges the stop member toward said engaged state.

5. The sliding closure according to claim 1, further comprising a handle for moving said stop member into said disengaged state.

6. The sliding closure according to claim 1, wherein said abutment surface is provided by a holding member, said holding member having a first side portion and a second side portion such that when the panel is in the closed position, at least part of said panel is disposed between said first side portion and said second side portion, said abutment surface comprising a surface of said first side portion, said second side portion including a panel abutment region in opposing relation to said stop member such that, when said stop member is in said engaged state and force is applied to slide said panel along said path from said closed position towards said open position, said panel is pressed between said stop member and said panel abutment region.

7. A sliding closure for selectively closing an opening comprising:

a panel mounted relative to the opening so as to be slidable between an open position and a closed position along a path extending across at least part of the opening in a direction parallel to a plane of said panel, said plane extending through a majority of said panel and said panel having an external surface extending parallel to the plane of the panel from a leading edge of said panel to a trailing edge of said panel and from a top edge of said panel to a bottom edge of said panel;

at least one abutment surface disposed in a fixed relation to said path; and a stop member rotatably supported about an axis of rotation, said stop member having a cam surface, wherein said stop member is rotatable between a disengaged state in which said stop member allows sliding of said panel along said path, and, when said panel is in said closed position, an engaged state in which said stop member engages and is compressed by said at least one abutment surface and a planar region of said external surface parallel to the plane of said panel and located between said leading and trailing edges of said panel so as to prevent sliding of said panel along said path from said closed position towards said open position as said panel is urged from said closed position towards said open position along said path, wherein when said stop member is in said engaged state, sliding of said panel along said path from said closed position towards said open position is opposed by friction generated by said stop member pressing against said planar region of said external surface.

8. The sliding closure according to claim 7, wherein the opening is at least partly bounded by a frame, and wherein said abutment surface comprises a surface of an elongated member of said frame.

9. The sliding closure according to claim 7, wherein said stop member is an elongated element.

10. The sliding closure according to claim 7, further comprising a return mechanism bearing against said stop member and configured to urge the stop member toward said engaged state when said panel is in the closed position.

11. The sliding closure according to claim 7, further comprising a handle for moving said stop member into said disengaged state.

12. The sliding closure according to claim 7, wherein said abutment surface is provided by a holding member, said holding member having a first side portion and a second side portion such that when the panel is in the closed position, at least part of said panel is disposed between said first side portion and said second side portion, said abutment surface comprising a surface of said first side portion, said second side portion including a panel abutment region in opposing relation to said stop member such that, when said stop member is in said engaged state and force is applied to slide said panel along said path from said closed position towards said open position, said panel is pressed between said stop member and said panel abutment region.

* * * * *